US009012813B2

(12) United States Patent
Mourad

(10) Patent No.: US 9,012,813 B2
(45) Date of Patent: Apr. 21, 2015

(54) HAIRSTYLING DEVICE

(76) Inventor: Joseph Mourad, Sydney (AU)

( * ) Notice: Subject to any disclaimer, the term of this patent is extended or adjusted under 35 U.S.C. 154(b) by 747 days.

(21) Appl. No.: 12/064,290

(22) PCT Filed: Aug. 25, 2006

(86) PCT No.: PCT/AU2006/001244

§ 371 (c)(1),
(2), (4) Date: Feb. 20, 2008

(87) PCT Pub. No.: WO2007/022600

PCT Pub. Date: Mar. 1, 2007

(65) Prior Publication Data

US 2008/0236604 A1 Oct. 2, 2008

(30) Foreign Application Priority Data

Aug. 26, 2005 (AU) ..... 2005904653

(51) Int. Cl.

| | |
|---|---|
| ***A45D 1/04*** | (2006.01) |
| ***A45D 20/10*** | (2006.01) |
| ***A45D 20/12*** | (2006.01) |
| ***A45D 20/50*** | (2006.01) |
| *A45D 1/18* | (2006.01) |

(52) U.S. Cl.
CPC *A45D 20/50* (2013.01); *A45D 1/04* (2013.01); *A45D 1/18* (2013.01)

(58) Field of Classification Search
None
See application file for complete search history.

(56) References Cited

U.S. PATENT DOCUMENTS

| | | | | |
|---|---|---|---|---|
| 3,150,393 | A | 9/1964 | Taylor et al. | |
| 3,854,489 | A * | 12/1974 | Doyle et al. | 132/112 |
| 4,023,578 | A | 5/1977 | Buhler | |
| 4,280,517 | A | 7/1981 | Ihara | |
| 4,520,256 | A * | 5/1985 | Doyle | 219/225 |
| 5,400,809 | A * | 3/1995 | Adams | 132/118 |
| 5,592,749 | A * | 1/1997 | Trimmer | 34/97 |
| 6,895,975 | B2 * | 5/2005 | Hafemann | 132/228 |
| 7,465,904 | B2 * | 12/2008 | Kim et al. | 219/222 |
| 2006/0108344 | A1 * | 5/2006 | Kim et al. | 219/225 |
| 2006/0207625 | A1 * | 9/2006 | Chan | 132/224 |
| 2006/0237418 | A1 * | 10/2006 | Bousfield et al. | 219/225 |
| 2008/0041409 | A1 * | 2/2008 | Leung | 132/224 |

FOREIGN PATENT DOCUMENTS

| | | | |
|---|---|---|---|
| CN | 2904744 | Y * | 5/2007 |
| DE | 8717038 | U1 | 2/1988 |
| JP | 2003174920 | A | 6/2003 |
| JP | 2004216179 | A | 8/2004 |
| JP | 2004267787 | A * | 9/2004 |
| KR | 2004095375 | A * | 11/2004 |

* cited by examiner

*Primary Examiner* — Joseph M Pelham

(57) ABSTRACT

The present invention provides a hairstyling device (10) comprising an elongate arm (12) having a hair receiving surface (14). Within the arm (12) there is an air passageway (16) that carries air injected into it by a fan (18). The air passageway (16) has an elongate air outlet (24) which is parallel to the arm (12). The air outlet (24) is configured to blow air along the length of the hair. Attached to the hair receiving surface (14) are bristles (26) to form a brush.

14 Claims, 21 Drawing Sheets

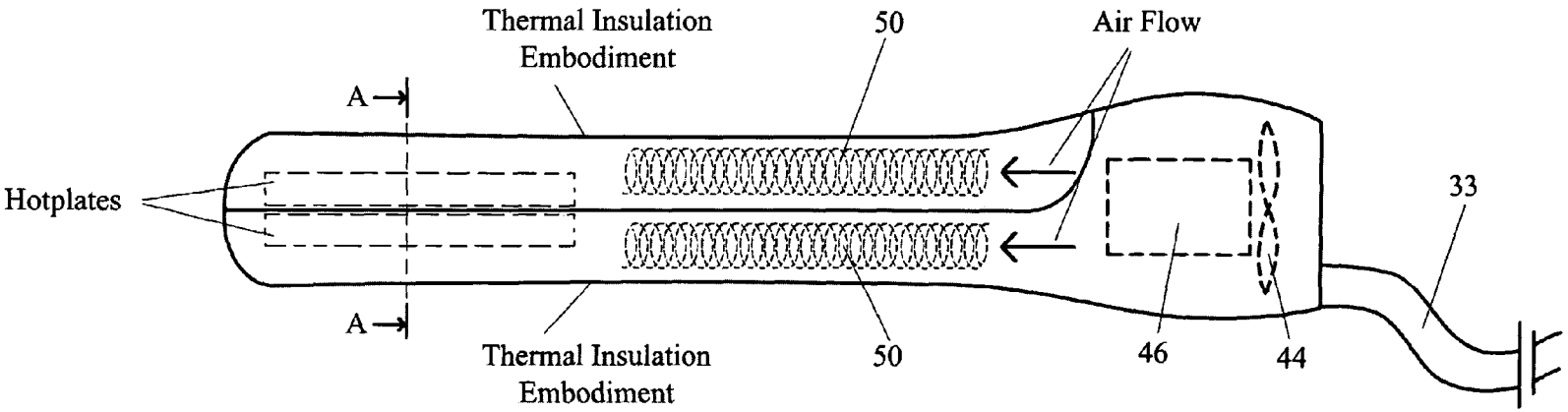
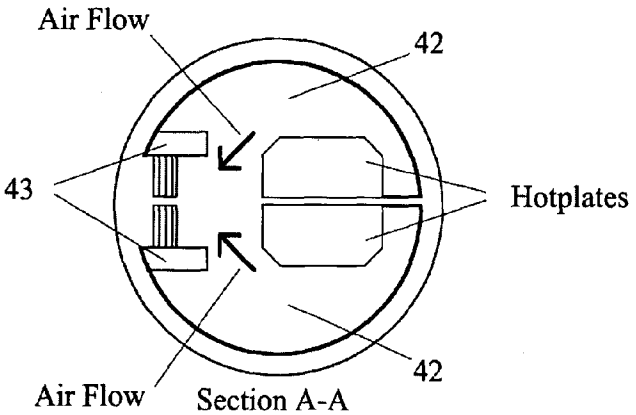
Figure 3A

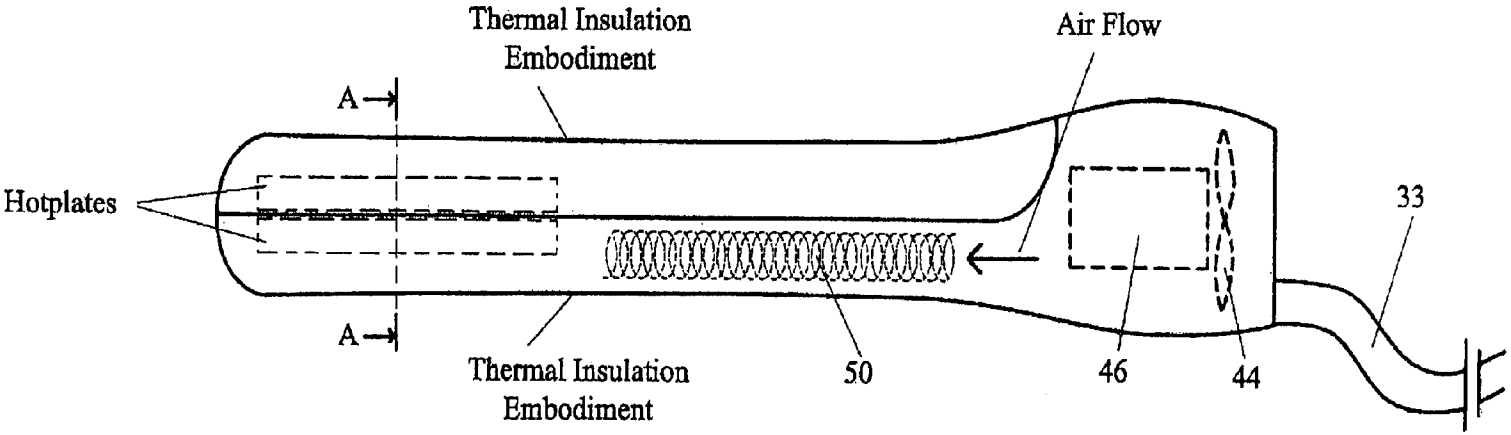
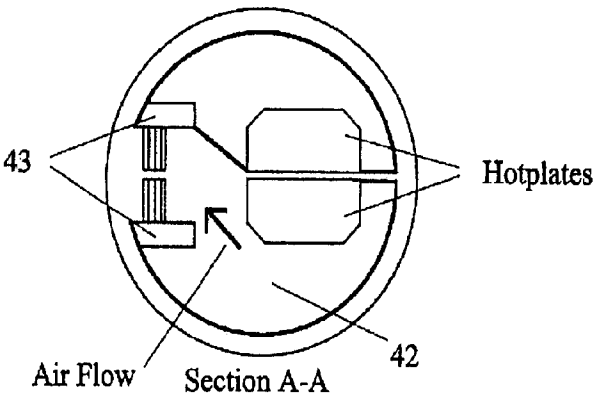
Figure 5

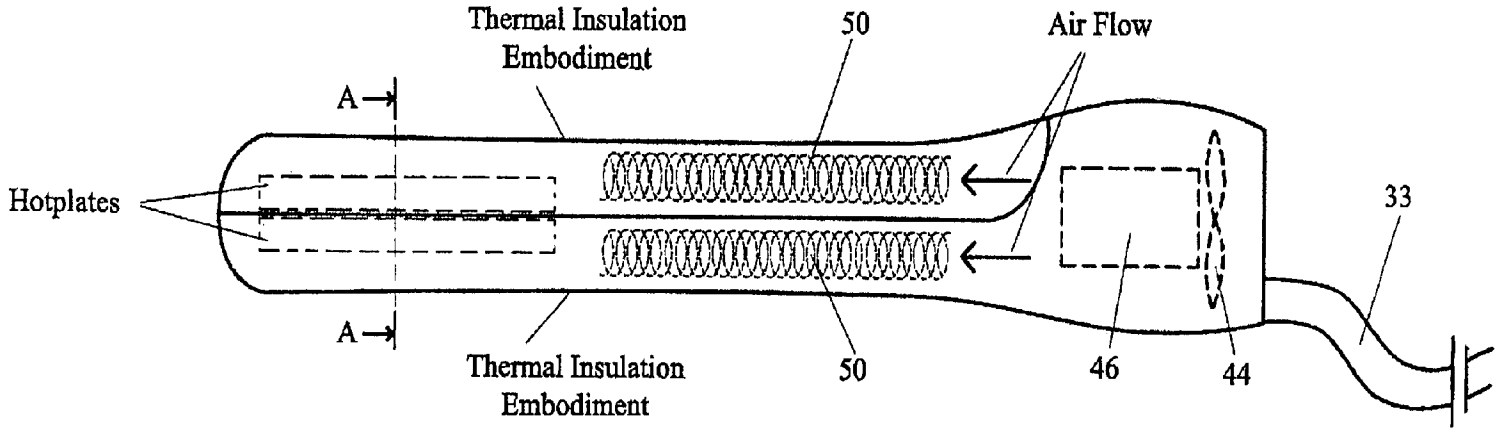
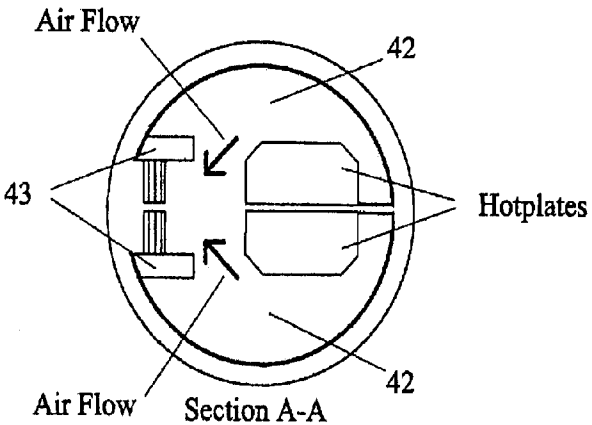
Figure 6

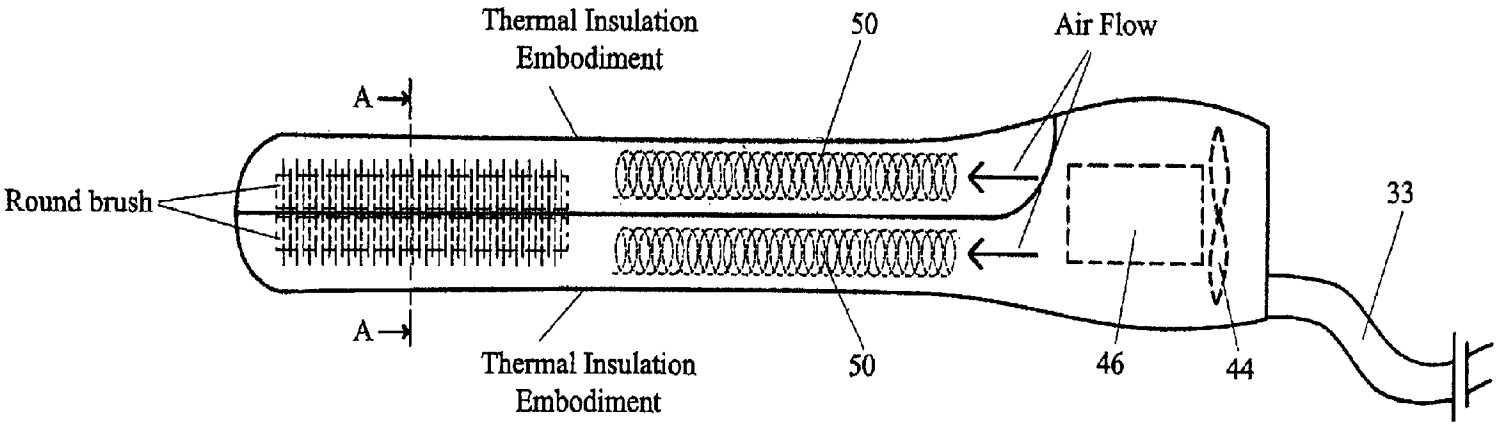
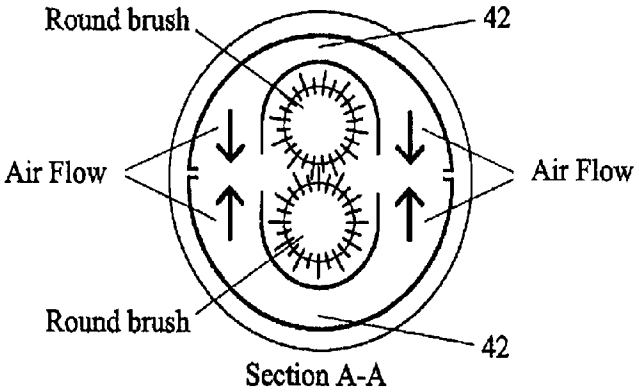
Figure 8

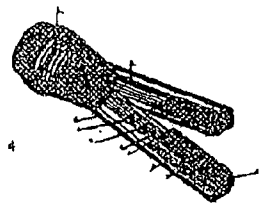

no 4

HAIR DRYER COMBO

BRISTLES+AIR

| ITEM No | NAME | SHAPE | FUNCTION | COLOR | MATERIAL | DIMENSIONS ALL IN MILLIMITERS |
|---|---|---|---|---|---|---|
| 1 | MOTOR | | TO FAN FORCE AIR THROUGH | ? | PLASTIC OR OTHER | |
| 2 | BOTTOM HOUSING | | HAND GRIP | ? | PLASTIC OR OTHER | |
| 3 | TOP HOUSING | | HAND GRIP | ? | PLASTIC OR OTHER | |
| 4 | BLOWDRYER SWITCH | | TURN ON/OFF | ? | PLASTIC OR OTHER | |
| 5 | HOT PLATE SWITCH | | TURN ON/OFF | ? | PLASTIC OR OTHER | |
| 6 | STOP KNOB | | HOUSING STOP ADJUSTMENT | ? | PLASTIC OR OTHER | |
| 7 | BACKING PATE-1 AND-2 | | AIR FLOW ALIGNMENT | ? | PLASTIC OR OTHER | |
| 8 | BRISTLES | | HAIR BRUSH | ? | PLASTIC OR OTHER | |
| 9 | AIR CHUTE | | TRASNFER HOT AIR DIRECTLY ONTO HAIR | ? | PLASTIC OR OTHER | |

ALL DIMENSIONS,SHAPES AND COLORS ARE SUBJECTED TO UNRESTRICTED VARIATIONS

Figure 10

HAIR DRYER COMBO

ROUND BRUSH+AIR

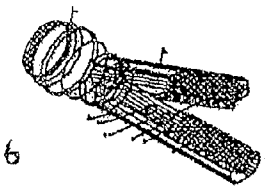

no 6

ROUND BRUSH+AIR

| ITEM No | NAME | SHAPE | FUNCTION | COLOR | MATERIAL | DIMENSIONS ALL IN MILLIMITERS |
|---|---|---|---|---|---|---|
| 1 | MOTOR | | TO FAN FORCE AIR THROUGH | ? | PLASTIC OR OTHER | |
| 2 | BOTTOM HOUSING | | HAND GRIP | ? | PLASTIC OR OTHER | |
| 3 | TOP HOUSING | | HAND GRIP | ? | PLASTIC OR OTHER | |
| 4 | BLOWDRYER SWITCH | | TURN ON/OFF | ? | PLASTIC OR OTHER | |
| 5 | HOT PLATE SWITCH | | TURN ON/OFF | ? | PLASTIC OR OTHER | |
| 6 | STOP KNOB | | HOUSING STOP ADJUSTMENT | ? | PLASTIC OR OTHER | |
| 7 | BACKING PATE-1 AND-2 | | AIR FLOW ALIGNMENT | ? | PLASTIC OR OTHER | |
| 8 | BRISTLES | | HAIR BRUSH | ? | PLASTIC OR OTHER | |
| 9 | AIR CHUTE | | TRASNFER HOT AIR DIRECTLY ONTO HAIR | ? | PLASTIC OR OTHER | |

ALL DIMENSIONS ARE SUBJECTED TO UNRESTRICTED VARIATIONS

Figure 12

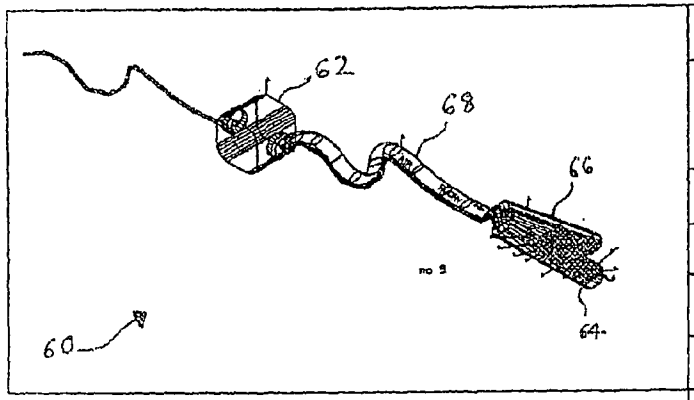

HAIR DRYER COMBO

BRISTLES+2HOTPLATES+AIR

| ITEM No | NAME | SHAPE | FUNCTION | COLOR | MATERIAL | DIMENSIONS ALL IN MILLIMETERS |
|---|---|---|---|---|---|---|
| 1 | MOTOR | | TO FAN FORCE AIR THROUGH | ? | PLASTIC OR OTHER | |
| 2 | AIR TUBE | | TO TRANSFER AIR BETWEEN MOTOR AND BRUSH HOUSING | ? | FLEXIBLE RUBBER/SPRING OR OTHER | 8 26MM 2000MM LONG |
| 3 | BOTTOM HOUSING | | HAND GRIP | ? | PLASTIC OR OTHER | |
| 4 | TOP HOUSING | | HAND GRIP | ? | PLASTIC OR OTHER | AS BOTTOM HOUSING |
| 5 | BLOWDRYER SWITCH | | TURN ON/OFF | ? | PLASTIC OR OTHER | |
| 6 | HOT PLATE SWITCH | | TURN ON/OFF | ? | PLASTIC OR OTHER | |
| 7 | STOP KNOB | | HOUSING STOP ADJUSTMENT | ? | PLASTIC OR OTHER | |
| 8 | BACKING PATE-1 AND-2 | | AIR FLOW ALIGNMENT | ? | PLASTIC OR OTHER | |
| 9 | BRISTLES | | HAIR BRUSH | ? | SELECTED MATERIAL OR OTHER | |
| 10 | AIR CHUTE | | TRANSFER FOR HOT AIR DIRECTLY ONTO HAIR | ? | PLASTIC OR OTHER | |
| 11 | HOT PLATE-1 and -2 | | HEATS UP TO STRAIGHTEN HAIR | ? | METAL / CERAMIC OR OTHER | |
| 12 | ELECTRICAL CORD | | POWER SUPPLY | ? | PVC OR OTHER | 8 8MM 2000MM LONG |
| 11 | HOT PLATE-1 and -2 | | HEATS UP TO STRAIGHTEN HAIR | ? | METAL / CERAMIC OR OTHER | |

ALL DIMENSIONS, SHAPES AND COLORS ARE SUBJECTED TO UNRESTRICTED VARIATIONS

Figure 13 no 5

HAIRSTYLING DEVICE

FIELD OF THE INVENTION

The present invention relates broadly to a hairstyling device.

BACKGROUND OF THE INVENTION

Hairstyling often requires drying wet or moist hair. This is traditionally done by directing hot air from a blow dryer onto the hair. This process however, gives the hair a frizzy texture that is not compatible with many desirable hairstyles.

Frizzy hair can be prevented somewhat by the application of a brush to the hair while blow drying hair. Furthermore, the brush and blow dryer combination can achieve a remarkable variety of desirable hairstyles. However, achieving high quality styling with the simultaneous use of a hair brush and blow dryer requires a skilled operator. It can take many years of training before the operator can achieve a satisfactory skill level.

One hairstyle that is particularly difficult to achieve using the brush and blower combination is straight and flat hair. To achieve this style some professional hairstylists use chemical hair straightening techniques, such as "Japanese hair straightening". It will be understood however, that this is an expensive, permanent process that takes many hours and can result in damage to the hair.

Other stylists use hair irons, also known as straightening irons or hair tongs, which can be used to temporarily straighten hair. Hair irons change the structure of the hair by pressing the hair between two hot iron surfaces. Some hair irons are applied to the hair after blow drying. Others are applied to wet hair.

SUMMARY OF THE INVENTION

According to one aspect of the invention there is provided a hair styling device comprising:

- an elongate arm having a hair receiving surface extending along at least part of the arm;
- an air passageway coupled to the arm and being in fluid communication with an elongate air outlet associated with the hair receiving surface, the elongate air outlet being disposed substantially parallel to the arm and configured to blow air substantially along the length of the hair; and
- brush-means attached to the arm at or adjacent the hair receiving surface.

According to another aspect of the invention there is provided a hair styling device comprising:

- a pair of tongs including two elongate arms being closable with respect to one another, each of the arms having a hair receiving surface;
- a heating element connected to one of the hair receiving surfaces;
- an air passageway coupled to at least one of the arms and being in fluid communication with an air outlet associated with the hair receiving surface of that arm;
- air heating means operatively coupled to the air passageway for heating air blown through the passageway and exiting the elongate air outlet; and
- brush means attached to at least one of the arms at or adjacent the hair receiving surface.

Preferably the hairstyling device includes a fan operatively coupled to the air passageway for blowing air through the air passageway and the air outlet. More preferably the fan is mounted in a fan casing rigidly attached to the one or more arms. Alternatively the fan is mounted in a fan casing connected to a flexible pipe which is a continuation of the air passageway.

Preferably the device includes an air heater operatively coupled to the air passageway. More preferably the air heater is mounted in the fan casing.

Preferably the brush means include one or more rows of flat bristles. Alternatively or additionally the brush means include a rotationally mounted brush, the brush being coupled to motor means for driving the brush in a circular motion.

Preferably the one or more hair receiving surfaces are spring loaded relative to their respective arms.

Preferably the elongate arms are biased or urged away from one another into an open position.

Preferably the hairstyling device is of a modular design including a handle to which the elongate arm or pair of tongs are detachably connected.

Preferably the hair-styling device includes batteries for powering it. Alternately the hairstyling device is adopted to be powered by mains power.

BRIEF DESCRIPTION OF THE FIGURES

In order to achieve a better understanding of the nature of the present invention, several preferred embodiments of a hairstyling device will now be described, by way of example only, with reference to the accompanying figures in which

FIG. 3*a* shows an elevational and cross-sectional view of another embodiment of a hairstyling device, similar to the embodiment of FIG. 3.

FIGS. 5 through to 12 show several other embodiments of a hairstyling device, the embodiments being similar to the embodiment of FIG. 3;

FIG. 13 shows another embodiment of a hairstyling device where the fan casing is connected to the arms by a flexible pipe;

DETAILED DESCRIPTION OF THE PREFERRED EMBODIMENTS

Figure 1:
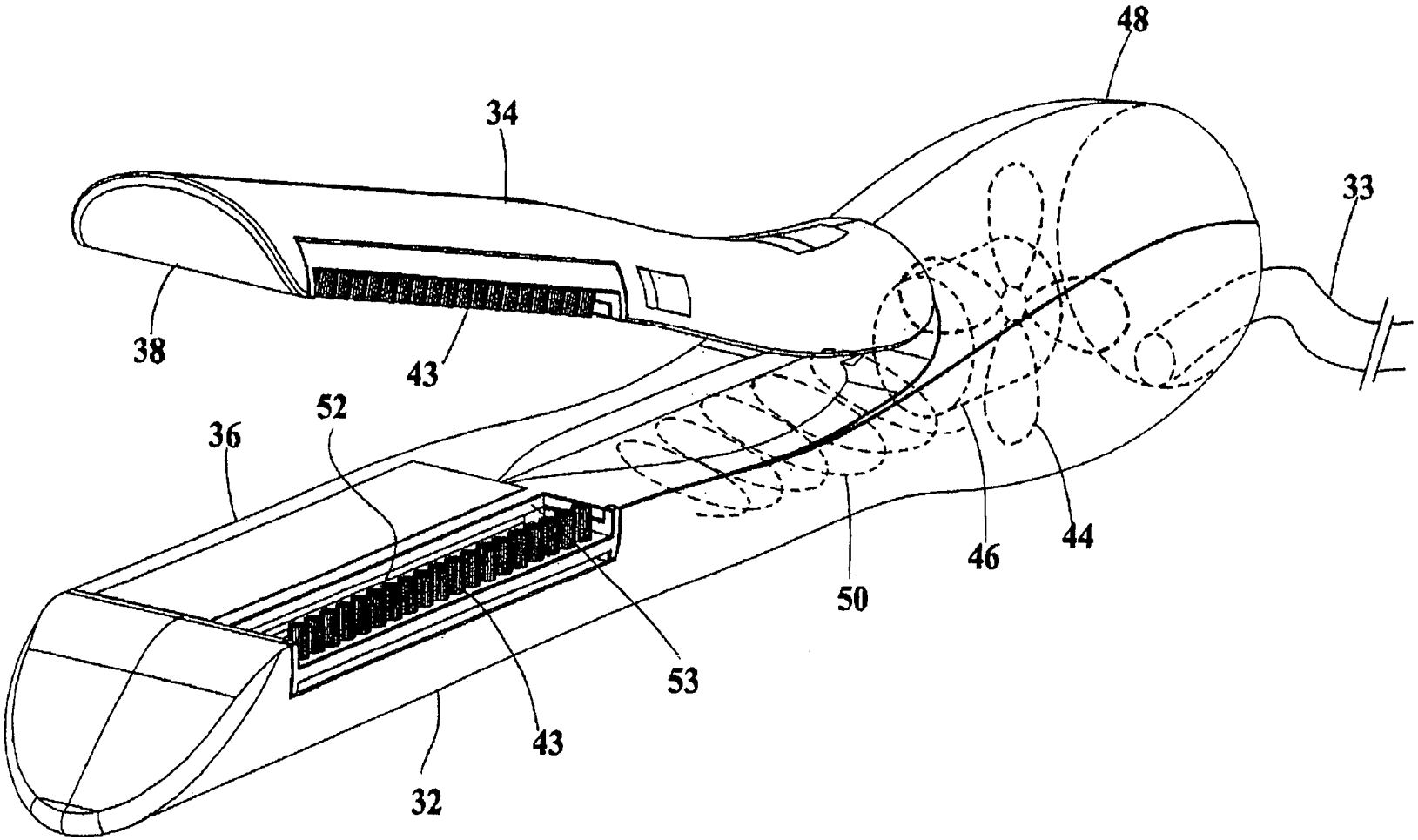
FIG. 1 shows a perspective view of one embodiment of a hairstyling device.
Figure 2:
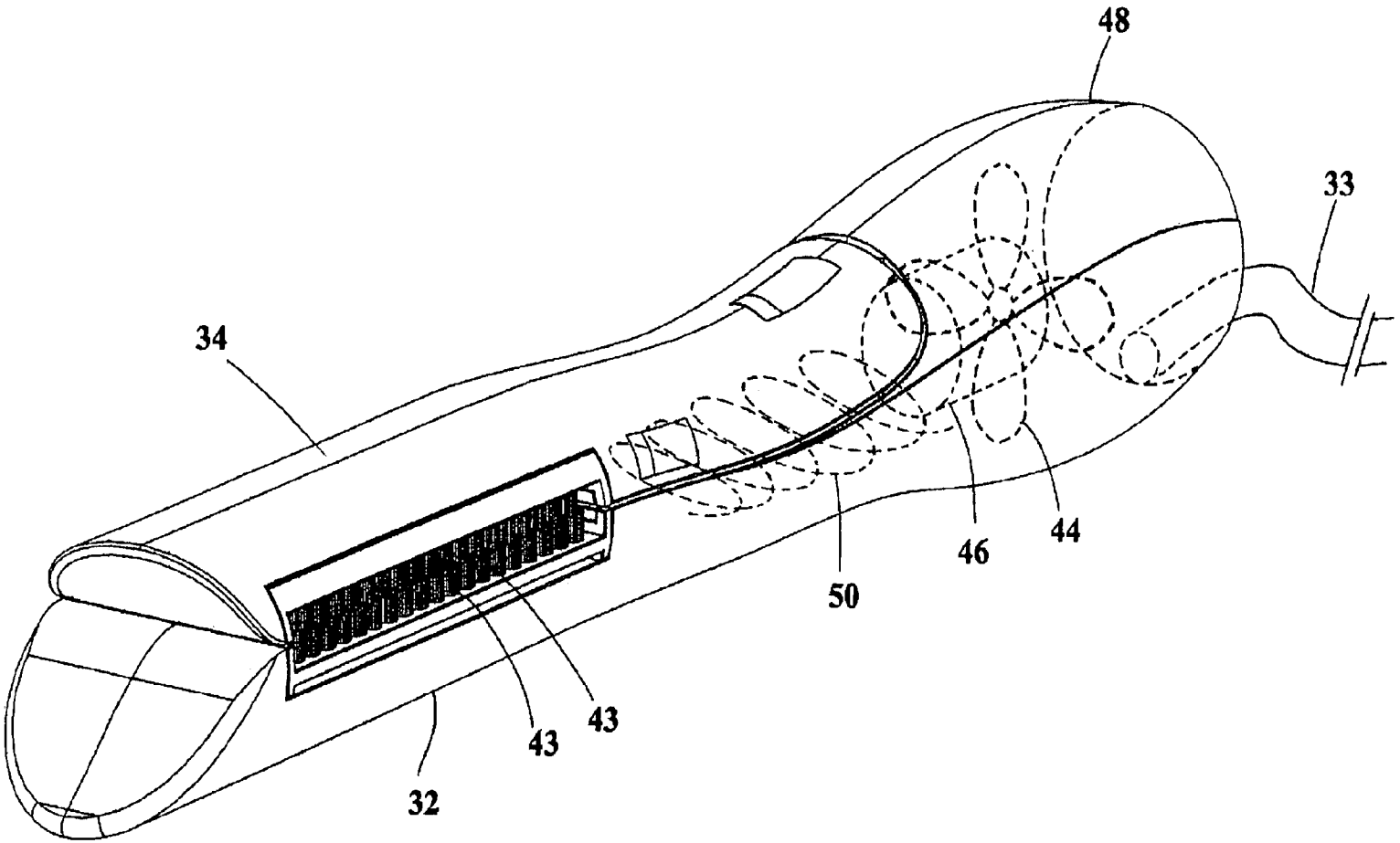
FIG. 2 shows a plan view of the hairstyling device of FIG. 1.

One embodiment of a hairstyling device is shown in FIGS. 1 and 2 and generally indicated as 10. The hairstyling device 10 has an elongate arm 12 having a flat and generally rectangular hair receiving surface 14 that extends along part of the arm 12. The hair receiving surface 14 may be made of ceramic or a metal such as aluminium or plastic. Within the arm 12 there is an air passageway 16 that carries air injected into it by a fan 18 driven by an electric motor 20. In this embodiment the fan 18 and motor 20 are mounted in a fan casing 22 rigidly attached to the arm 12, the fan casing 22 also including heating elements 23 to heat the air.

In some other embodiments, however, the fan casing is separate to the arm 12 but connected to the arm 14 by a flexible pipe which is a continuation of the air passageway 16.

The air passageway 16 has an elongate air outlet 24 which is parallel to the arm 12 and extends along the side of the hair receiving surface 14. The air outlet 24 is configured to blow air across the hair receiving surface 14 and thus substantially along the length of the hair placed perpendicular to the arm 12 and on the surface 14. Attached to the hair receiving surface 14 are bristles 26 to form a brush, although in some embodiments the bristles 26 may be placed along an edge of the surface 14. The bristles could be made of nylon; wire, metal, copper, bone, plastic, aluminium, pure bristle or any other type of bristle. In some embodiments not illustrated here, the brush is rotationally mounted on the arm 12 and coupled to an electric motor for driving the brush in a circular motion. The brush is round, but could be another shape such as square. This would help tension the hair.

The hairstyling device 10 is of a modular design and includes a handle or hand grip 28.

This embodiment of a hairstyling device is mains powered, however it may alternatively be powered by batteries.

Figure 3:
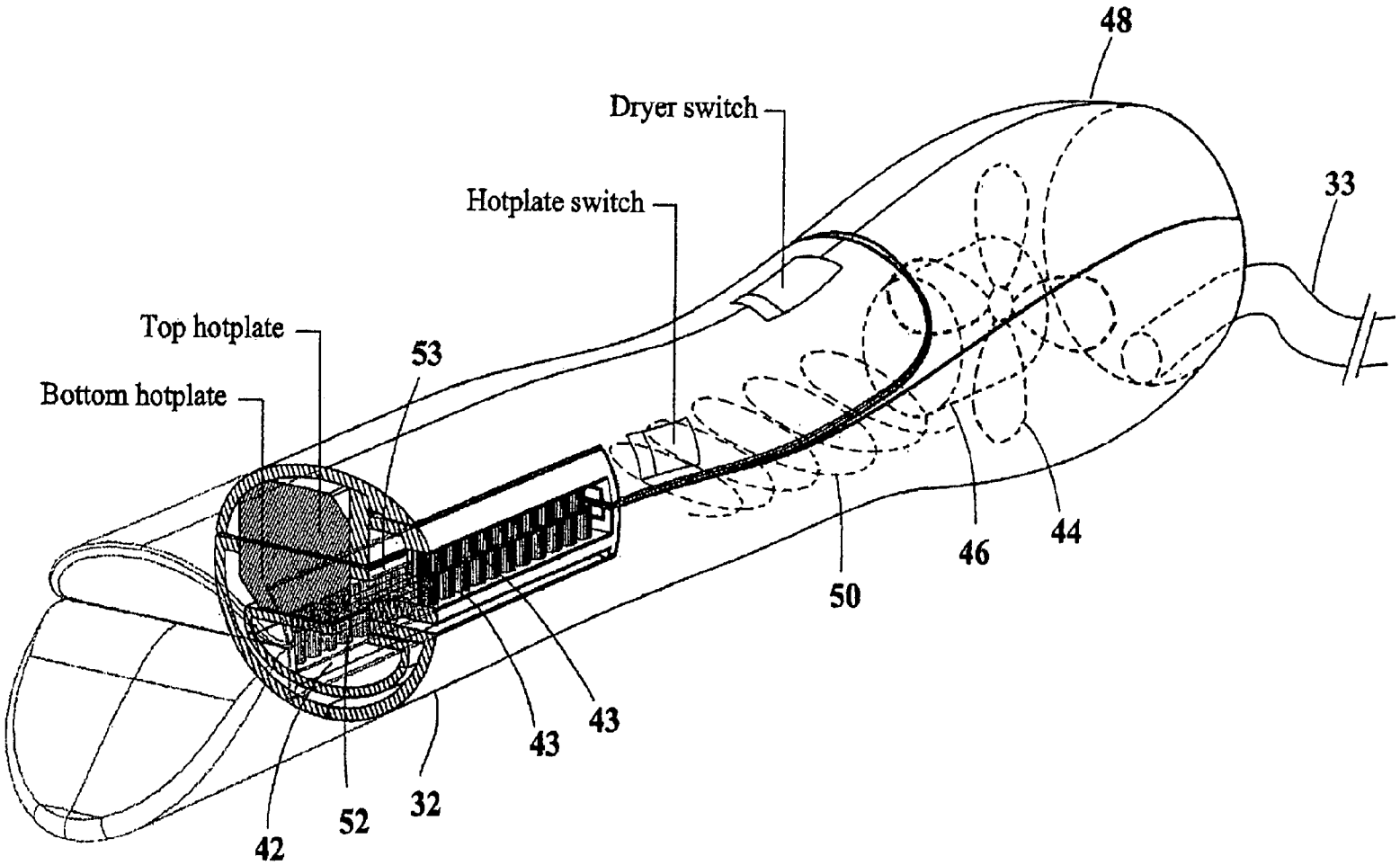
FIG. 3 shows a perspective view of another embodiment of a hairstyling device.

Another embodiment of hairstyling device is shown in FIG. 3, and is generally indicated as 30. The hairstyling device 30 has a pair of tongs including two elongate arms 32 and 34 that are closable with respect to one another. The arms 32 and 34 are biased or urged away from one another in an open position. Each arm has a generally rectangular hair receiving surface 36 and 38. The surface may be constructed, for example, of ceramic, aluminium or titanium. One or both of the hair receiving surfaces 36 and 38 are heated by a heating element 40 connected directly under the hair receiving surface 36. Within the arm 32 there is an air passageway 42 that carries air injected into it by a fan 44 driven by an electric motor 46. The fan 44 and motor 46 are mounted in a fan casing 48 attached to the arms 32 and 34, the fan casing 48 also including heating elements 50 to heat the air.

The air passageway 42 has an elongate air outlet 52 which is parallel to the arm 32 and extends along the side of the hair receiving surface 36. The air outlet 52 is configured to blow air across the hair receiving surface 36 and thus substantially along the length of hair placed perpendicular to the arm 32 on the surface 36. Attached to the hair receiving surfaces 36 and 38 are bristles 43 to form a brush, although in some embodiments the bristles may be alternatively placed along an edge of the surfaces 36 and 38. In some embodiments, the brush is rotationally mounted on the arm 12 and coupled to an electric motor for driving the brush in a circular motion. This would help to tension the hair.

The hair receiving surfaces 36 and 38 are spring loaded relative to their respective arms 32 and 34 to apply pressure to hair placed between the surfaces 36 and 38 before they are fully closed. There is approximately 2 mm of travel available to each surface.

Figure 4:
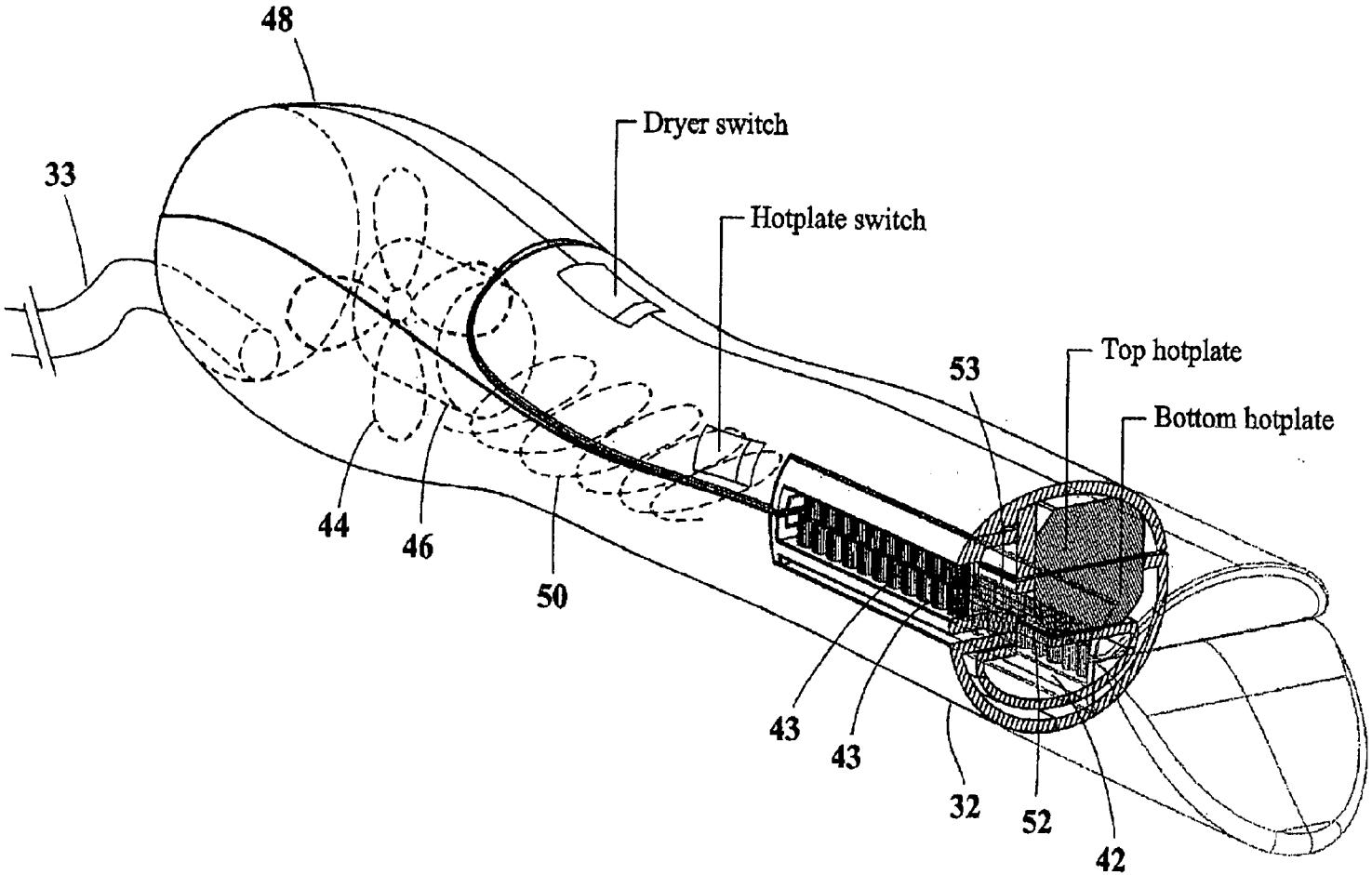
FIG. 4 shows some of the component parts of the hairstyling device of FIG. 3.
Figure 7:
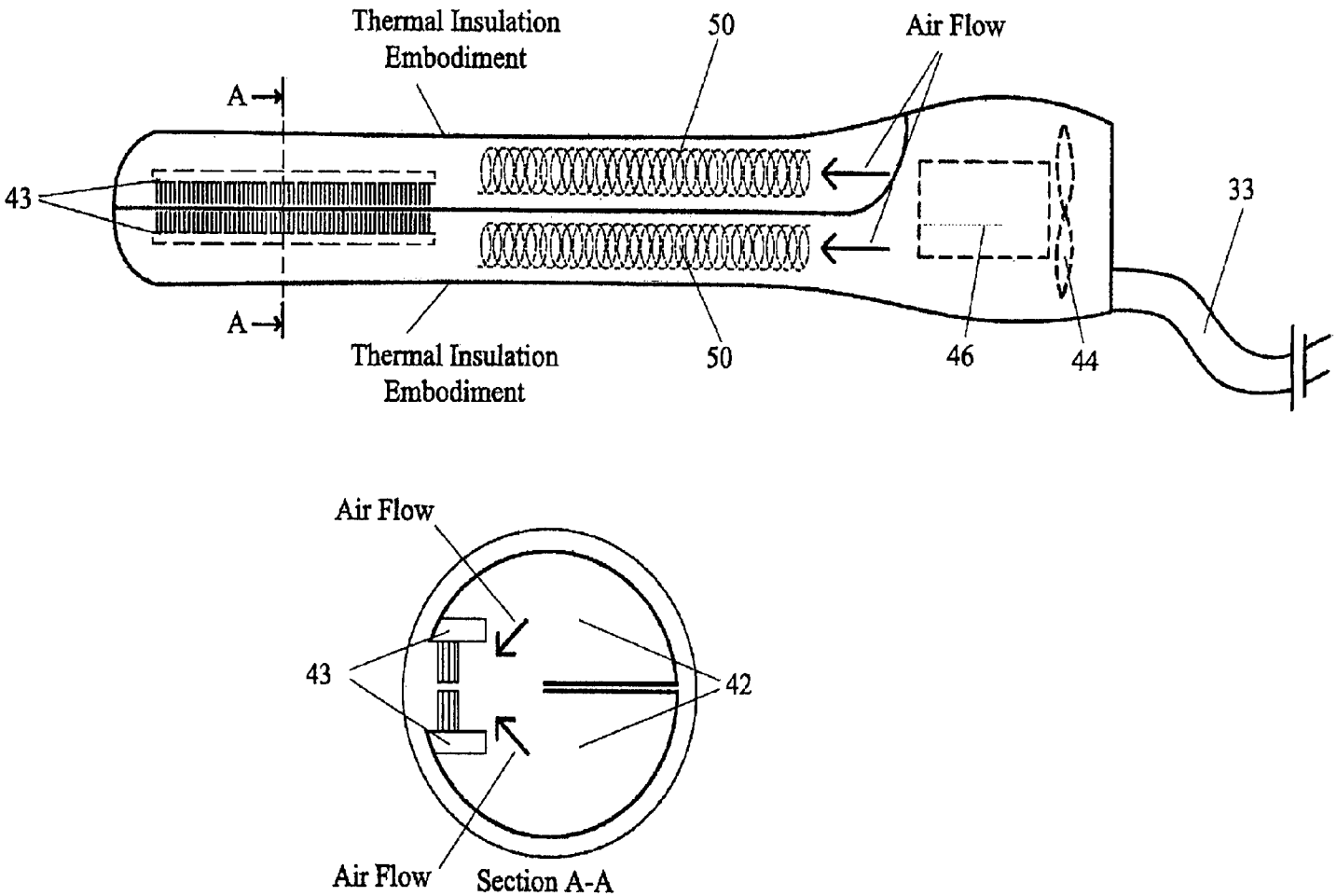
Figure 9:
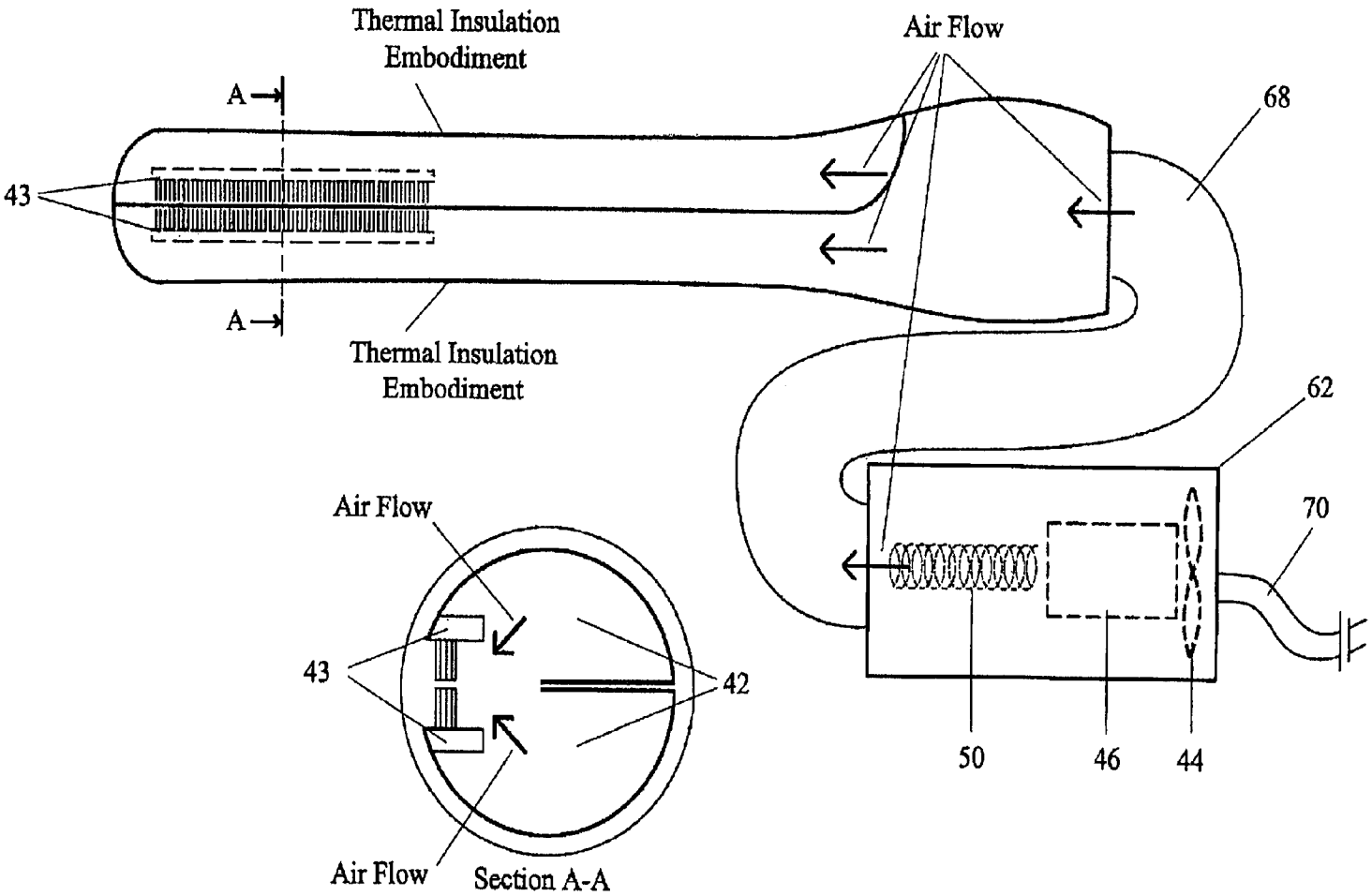
Figure 11:
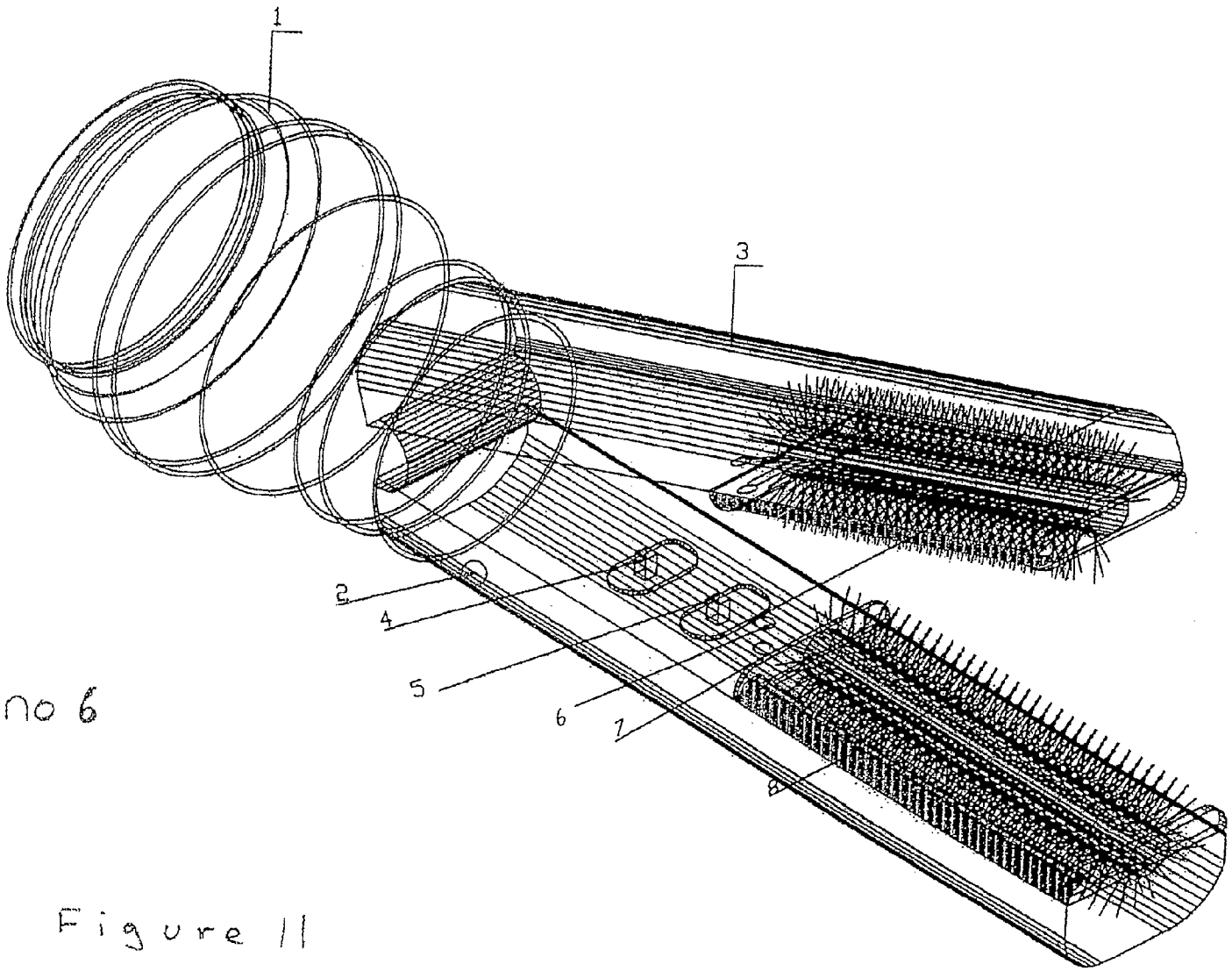

This embodiment of a hairstyling device is mains powered, however it may alternatively be powered by batteries. The hairstyling device is of a modular design and includes a handle or hand grip 53 to which the arm 12 or tongs are detachably connected. FIG. 4 shows some of the components of the hairstyling device of FIG. 3.

Another embodiment of a hairstyling device, similar to the embodiment of FIG. 3, is shown in FIG. 3*a* and indicated as 31. Features in FIG. 3*a* that are common in function to features in FIG. 3 have been identically numbered. The configuration of the elongate air outlet 52 is shown in section A-A of FIG. 3*a*. The air exiting the elongate air outlet 52 is deflected by a shroud 53 across the hair receiving surfaces 36 and 38 as indicated by the airflow lines. A distinguishing feature of the embodiment of FIG. 3*a* is that the air heating elements 50 are located within the arms 32 and 34. Another distinguishing feature is that the bristles mounted on a detachable strip run along one side of the hair receiving surfaces 36 and 38. The hairstyling device has a power cord 33 for connecting it to mains power.

FIGS. 5 to 12 show other embodiments of a hairstyling device similar to that shown in FIGS. 3 and 4. The reference numerals used correspond to the parts listing of that drawing.

Figure 14:
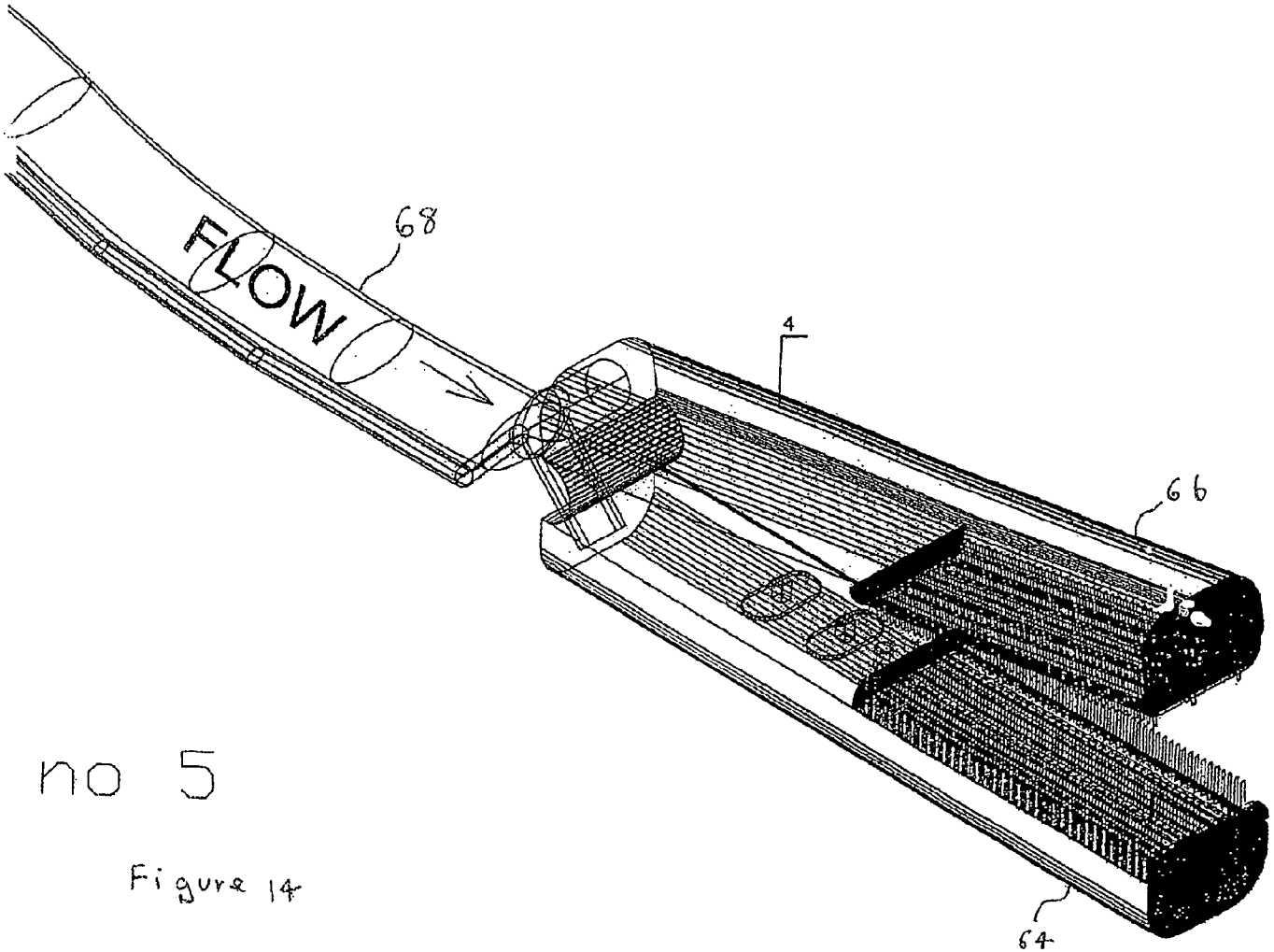
FIG. 14 is a close up perspective view of the arms of the hairstyling device of FIG. 13.
Figure 15:
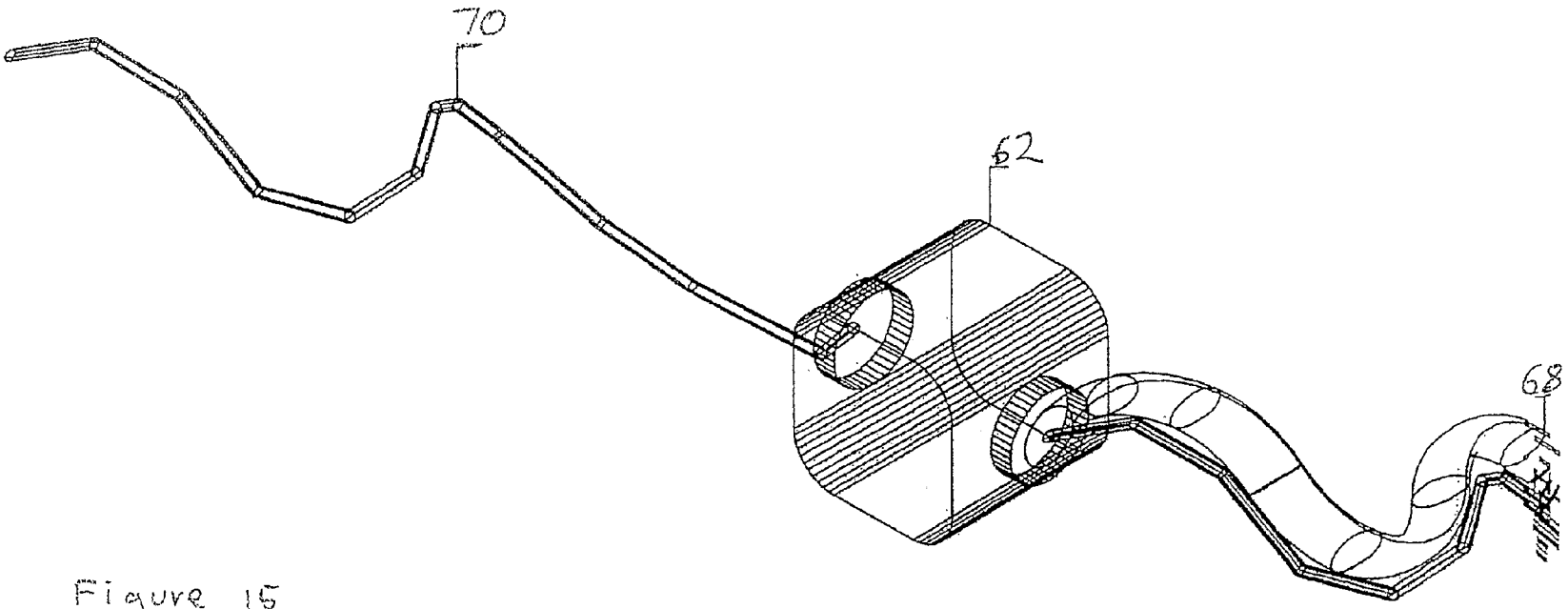
FIG. 15 is a close up perspective-view of the fan casing of the hairstyling device of FIG. 3.

FIG. 13 shows another embodiment of the hairstyling device generally indicated as 60. In this embodiment the fan casing 62 containing the fan, motor and heating element is separate to the arms 64 and 66 but connected to the arms 64 and 66 by a flexible pipe 68 for transporting the heated air. FIG. 14 shows a more detailed drawing of the arms 64 and 66. FIG. 15 shows a more detailed drawing of the fan casing 62, which is connected to mains power by a power cable 70.

Figure 16:
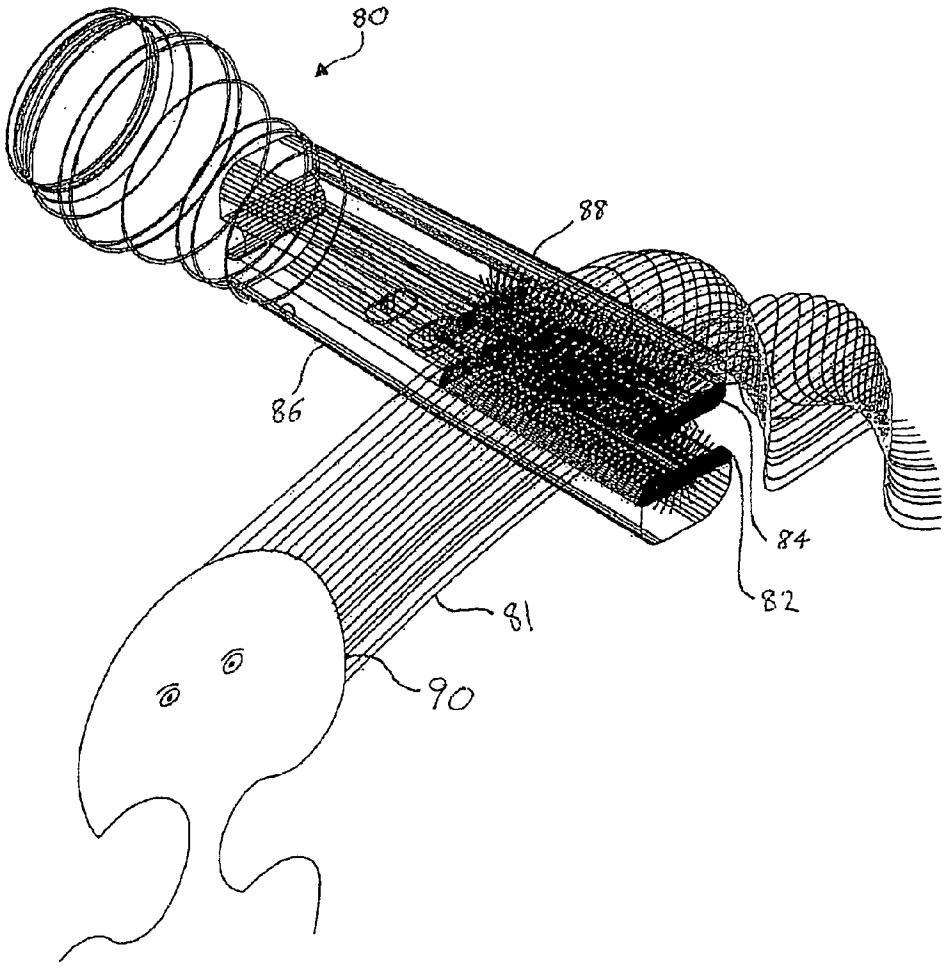
FIG. 16 is a perspective view of one embodiment of a hairstyling device in use.

FIG. 16 shows an embodiment of a hairstyling device 80 of the invention in use. Hair 81 is placed between the hair receiving surfaces 82 and 84 and the arms 86 and 88 closed together to grasp the hair. The hairstyling device is then drawn along the tensioned hair 82, in a direction generally away from the scalp 90. The direction of air flow is also generally away from the scalp 90. Importantly, the air flow is directed substantially along the length of the hair away from the scalp 90.

Figure 17:
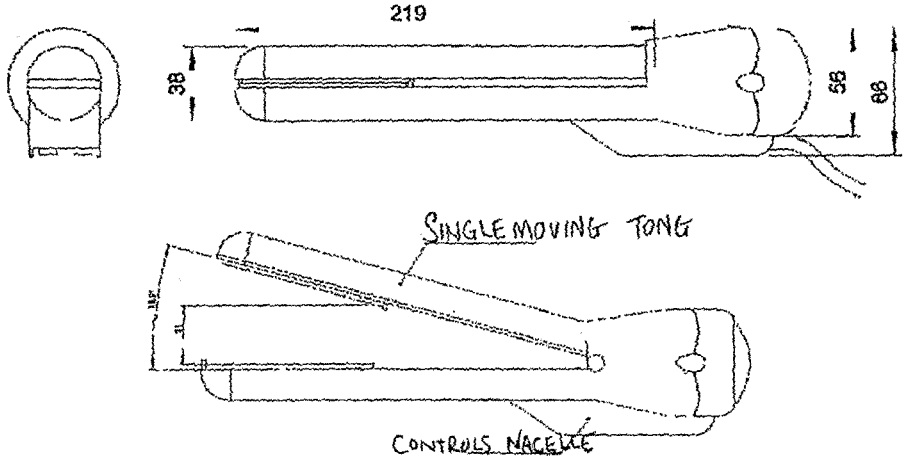
FIG. 17 is a specification sheet of one embodiment of a hairstyling device.
Figure 18:
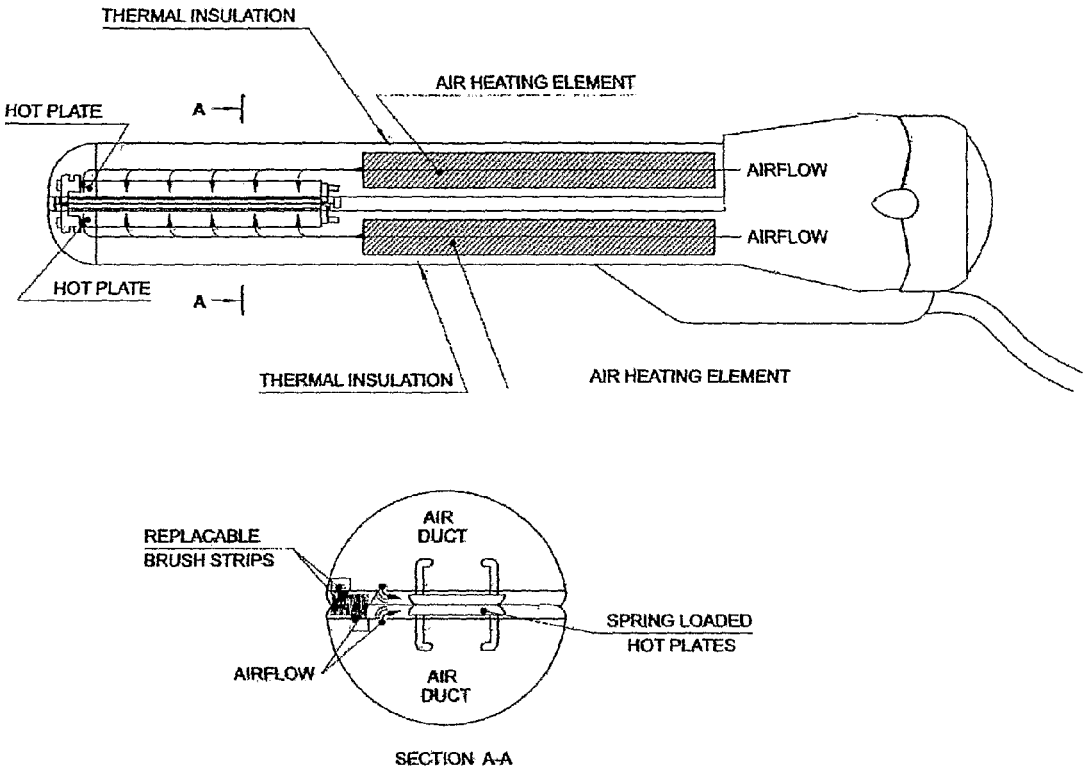
FIG. 18 is a continuation of the specification sheet of FIG. 17.
Figure 19:
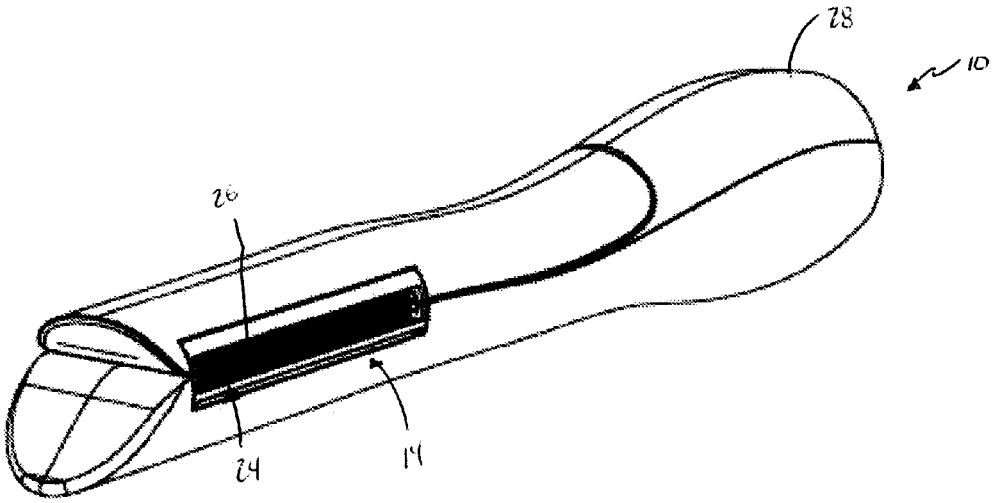
FIG. 19 is a perspective view of one embodiment of the hairstyling device.
Figure 20:
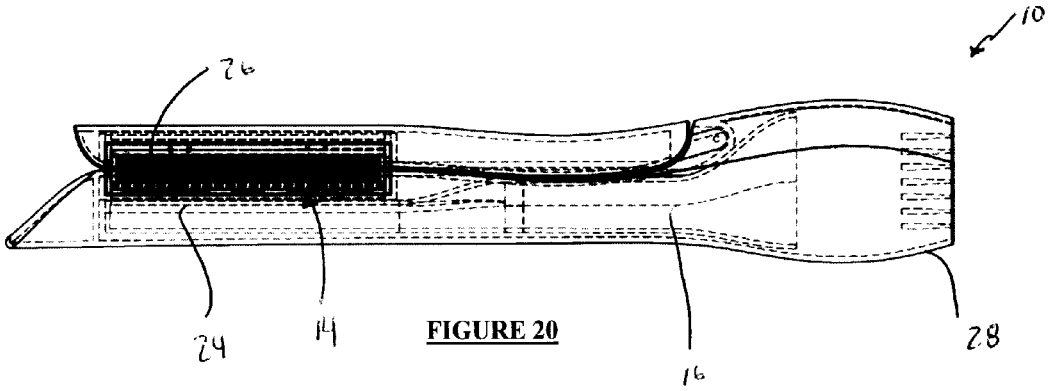
FIG. 20 is side plan view of one embodiment of the hairstyling device.
Figure 21:
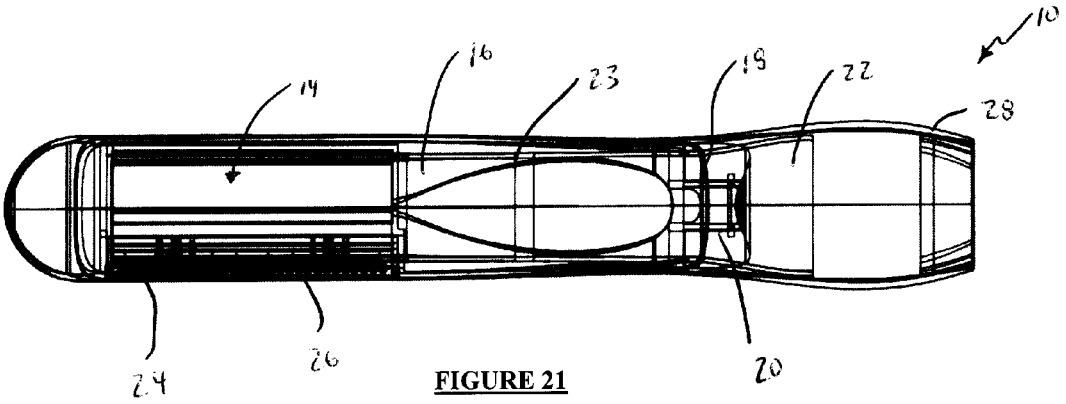
Figure 22:
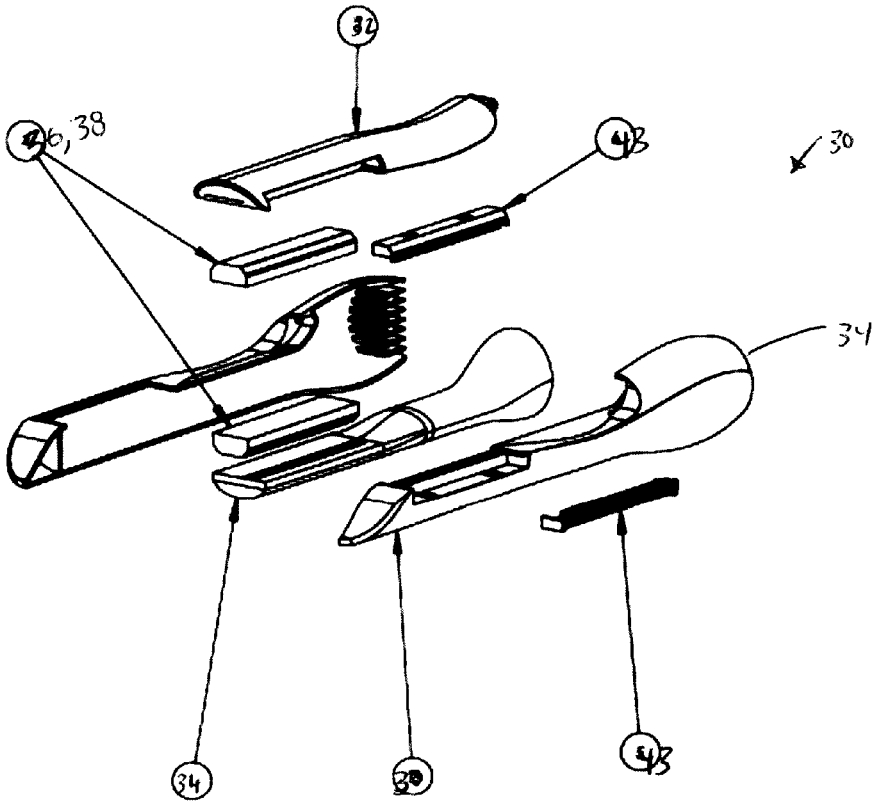

FIGS. 17 and 18 are specification sheets for one embodiment of a hairstyling device according to the invention.

It will be appreciated by persons skilled in the art that numerous variations and/or modifications may be made to the invention as shown in the specific embodiments without departing from the spirit or scope of the invention as broadly described. For example the hair receiving surfaces may not be a straightening plate but a flocked plate, a deep wave plate, or a mirco-crimp plate to curl, crimp, bend, flip, spiral, or straighten the hair. Additionally, there may be means to apply thermal protectors such as lotion to protect the hair during treatment or some other hair product. The brush means may be in the form of relatively rigid comb elements rather than the bristles described. The present embodiments are, therefore, to be considered in all respects as illustrative and not restrictive.

ANNEXURE 1

Refer FIG. 17

1 General

A mains operated, electrical device intended to combine the function of a hair dryer, hair brush & styling hot plates. The overall look & feel of the unit is to be of high quality with no sharp edges or visible fasteners.

2 Electrical 2.1 Able to be manufactured in both US spec, (110V, 60 Hz) & Aust/UK spec, (220-240V, 50 Hz) versions.

2.2 Double insulated.

2.3 Total Power Consumption=1800 W Max 2.4 Fan motor, encased, permanent magnet typed DC motor recommended.

2.5 Thermal overload protection required on each hot plate as well as air heating element.
2.6 Heated air controls, 3 settings as listed here:
2.6.1 No airflow, ie. off.
2.6.2 Full speed fan, 50% air heating.
2.6.3 Full speed fan, 100% air heating, (output air temp 100 Deg. C. min).
2.7 Hot plate heat controls independent of controls above are simply on & off. Hotplate working surface temperature 160 deg C. min.
2.8 2× Air heating elements required, one in each "tong".
2.9 The air heating elements must not be powered unless the fan is running.
3 Mechanical
3.1 Max total weight=750 g
3.2 Overall dimensions refer dwg below.
3.3 Tongs to be spring loaded to open to angle specified.
3.4 Controls must be recessed such that switch setting cannot be changed inadvertently.
3.5 All external surfaces smooth.

ANNEXURE 2

Refer FIG. 18

Tong Configuration
4.1 Each of the two tongs is to have 4 active components within it. Note that the position of these components, relative to each other is seen as critical & is shown in accompanying diagram:
4.1.1 Air heating element situated within the duct as shown in the diagram.
4.1.2 A spring loaded hot plate. The spring loading is necessary in order to apply pressure to the hair between the plates before they are fully closed. The hot plates need to be able to move approximately 1-2 mm.
4.1.3 Replaceable brush strips. These strips will wear out with use & must therefore be replaceable.
4.1.4 A long, narrow, curved duct incorporated in the housing so as to direct the heated air toward the adjacent hot plate. Refer diag.

The invention claimed is:

1. A hair styling device comprising:
at least one elongated arm having a substantially planar hair receiving surface extending along at least part of the arm;
an air passageway coupled to the at least one arm and being in fluid communication with an elongated air outlet associated with and disposed substantially parallel to a plane of the substantially planar hair receiving surface;
air heating means operatively coupled to the air passageway for heating air blown through the passageway and exiting the elongate air outlet; and
brush means attached to at least one of the arms at or adjacent the hair receiving surface;
wherein the elongated air outlet cooperates with a shroud disposed adjacent the hair receiving surface to blow air across the hair receiving surface and substantially along the length of the hair away from the scalp to dry and style the hair.

2. A hair styling device comprising:
a pair of tongs including two elongate arms being closable with respect to one another, each of the arms having a substantially planar hair receiving surface;
a heating element connected to at least one of the hair receiving surfaces;
an air passageway coupled to at least one of the arms and being in fluid communication with an elongate air outlet associated with and disposed substantially parallel to a plane of the substantially planar hair receiving surface;
air heating means operatively coupled to the air passageway for heating air blown through the passageway and exiting the elongate air outlet; and
brush means attached to at least one of the arms at or adjacent the hair receiving surface;
wherein the elongate air outlet cooperates with a shroud disposed adjacent the hair receiving surface to blow air across the hair receiving surface and substantially along the length of the hair away from the scalp to dry and style the hair.

3. A hairstyling device as claimed in claim 2
also comprising a fan operatively coupled to the air passageway for blowing air through the air passageway and the air outlet.

4. A hair styling device as claimed in claim 3
wherein the fan is mounted in a fan casing rigidly attached to the one or more arms.

5. A hair styling device as claimed in claim 3
wherein the fan is mounted in a fan casing connected to a flexible pipe which is a continuation of the air passageway.

6. A hair styling device as claimed in claim 5
wherein the air heater is mounted in either the fan casing or the one or more of the arms.

7. A hair styling device as claimed in claim 2
wherein the brush means include one or more rows of flat bristles.

8. A hair styling device as claimed in claim 2
wherein the brush means include a rotationally mounted brush, the brush being coupled to motor means for driving the brush in a circular motion.

9. A hair styling device as claimed in claim 2
wherein the one or more hair receiving surfaces are spring loaded relative to their respective arms.

10. A hair styling device as claimed in claim 2
wherein the elongate arms are biased or urged away from one another into an open position.

11. A hair styling device as claimed in claim 4 being of a modular design where the elongate arm or pair of tongs are detachably connected to the fan casing.

12. A hair styling device as claimed in claim 2 that is adapted to be battery powered.

13. A hair styling device as claimed in claim 2 that is adapted to be mains powered.

14. A hair styling device as claimed in claim 2 in which the elongate arm forms one of two elongate arms of a pair of tongs which are closable with respect to one another, and in which each of the arms has a hair receiving surface;
a heating element or plate being connected to at least one of the hair receiving surfaces; and
a heating means being provided operatively coupled to the air passageway for heating air blown through the air passageway and for exiting hot air through the elongated air outlet parallel and substantially along the length of the hair away from the scalp to style and dry the hair.

* * * * *